US011673718B2

(12) United States Patent
Creighton et al.

(10) Patent No.: US 11,673,718 B2
(45) Date of Patent: Jun. 13, 2023

(54) CONTAINER SYSTEM WITH A REMOVABLE CAP

(71) Applicant: Central Bag & Burlap Co., Denver, CO (US)

(72) Inventors: Michael Creighton, Warminster, PA (US); Ersen Boran, Warminster, PA (US); James W. Lowry, Franklin, TN (US)

(73) Assignee: CENTRAL BAG & BURLAP CO., Denver, CO (US)

( * ) Notice: Subject to any disclaimer, the term of this patent is extended or adjusted under 35 U.S.C. 154(b) by 12 days.

(21) Appl. No.: 17/085,138

(22) Filed: Oct. 30, 2020

(65) Prior Publication Data

US 2021/0276767 A1 Sep. 9, 2021

Related U.S. Application Data

(60) Provisional application No. 63/076,221, filed on Sep. 9, 2020, provisional application No. 62/986,898, filed on Mar. 9, 2020.

(51) Int. Cl.

| | |
|---|---|
| ***B65D 43/02*** | (2006.01) |
| ***B65D 51/20*** | (2006.01) |
| *B65D 50/06* | (2006.01) |

(52) U.S. Cl.

CPC ..... *B65D 43/0272* (2013.01); *B65D 51/20* (2013.01); *B65D 50/06* (2013.01);
(Continued)

(58) Field of Classification Search

CPC ..... B65D 2543/0037; B65D 43/022; B65D 41/28; B65D 43/021; B65D 50/00;
(Continued)

(56) References Cited

U.S. PATENT DOCUMENTS 2,867,342 A 1/1959 Baars et al.
2,963,189 A * 12/1960 Mazoyer ..... B65D 41/28 215/325

(Continued)

FOREIGN PATENT DOCUMENTS

WO WO 2005/021398 3/2005
WO WO 2011/036342 3/2011

OTHER PUBLICATIONS

Official Action for Canada Patent Application No. 3097566, dated Nov. 29, 2021, 4 pages.

(Continued)

*Primary Examiner* — Shawn M Braden

(74) *Attorney, Agent, or Firm* — Sheridan Ross P.C.

(57) ABSTRACT

A container and methods of manufacturing and operating the same are provided where the container has a cap that is removable yet childproof. The cap is positioned in a tubular body, and the cap has a generally smooth or continuous upper surface to reduce or eliminate surfaces or edges for a child to grasp. To operate the cap, a disc in the center of the cap is pushed below a lip, and a user grasps the lip to pull the cap from the tubular body. The force needed to press the disc away from the lip is low enough for an adult but too high for a child. Moreover, the cap forms an interference fit with the tubular body with enough friction force to prevent the cap from falling out of the tubular body but is low enough that the cap can be pulled from the tubular body.

20 Claims, 14 Drawing Sheets

(52) U.S. Cl.
CPC ..... *B65D 2543/00092* (2013.01); *B65D 2543/00425* (2013.01)

(58) Field of Classification Search
CPC .. B65D 50/045; B65D 43/0272; B65D 51/20; B65D 50/06; B65D 2543/00092; B65D 2543/00425; B65D 41/0414; B65D 41/045
See application file for complete search history.

(56) References Cited

U.S. PATENT DOCUMENTS

| | | | | |
|---|---|---|---|---|
| 3,130,848 | A | 4/1964 | Chancellor | |
| 4,393,977 | A | 7/1983 | Willingham | |
| 4,444,308 | A | 4/1984 | MacEwen | |
| 4,930,682 | A | 6/1990 | Gordon et al. | |
| 5,118,035 | A * | 6/1992 | Brochu ..... | B65D 43/022 229/125.17 |
| 5,228,274 | A | 7/1993 | De Man et al. | |
| 5,803,284 | A * | 9/1998 | Grimard ..... | B65D 51/002 215/249 |
| 5,960,972 | A | 10/1999 | Larguia, Sr. | |
| 7,484,652 | B2 | 2/2009 | Kalberer | |
| 8,939,311 | B2 | 1/2015 | Christopoulos et al. | |
| 9,365,334 | B2 | 6/2016 | Christopoulos et al. | |
| 9,598,211 | B2 | 3/2017 | Christopoulos et al. | |
| 10,011,393 | B2 | 7/2018 | Slack | |
| 10,051,875 | B2 | 8/2018 | Christopoulos et al. | |
| 10,214,328 | B2 | 2/2019 | Sorensen et al. | |
| 2011/0095022 | A1 * | 4/2011 | Yeung ..... | B65D 81/2038 220/240 |
| 2016/0083152 | A1 | 3/2016 | Eberlein | |
| 2019/0127107 | A1 | 5/2019 | Herlin et al. | |

OTHER PUBLICATIONS

International Search Report and Written Opinion for International (PCT) Patent Application No. PCT/US2021/021523, dated Jun. 3, 2021, 13 pages.

* cited by examiner

CONTAINER SYSTEM WITH A REMOVABLE CAP

CROSS REFERENCE TO RELATED APPLICATION

This application claims the benefit of U.S. Application Ser. No. 62/986,898, filed on Mar. 9, 2020, and this application claims the benefit of U.S. Application Ser. No. 63/076,221, filed on Sep. 9, 2020, the entire disclosures of which are hereby incorporated by reference in their entirety.

FIELD

Embodiments of the present disclosure are related to a container system that has a removable, yet childproof, cap.

BACKGROUND

Containers have long been used to store loose objects as well as consumable goods within a volume or recess of the container. A lid or cap can cover the volume or recess for storage of the objects or goods. One concern with some containers is the accidental consumption of contents within the container by, for example, a child. Up to 300 children are poisoned per day in the United States, mostly due to the accidental ingestion of hazardous materials, which includes goods such as medication stored in a container. This issue has not gone unnoticed as some containers have childproof features. Prescription bottles often have a childproof cap that requires a two-part process to remove the cap from the container. First, the cap is pressed downward against the container, and then the cap is rotated relative to the container to remove the cap from the container. The vast majority of children will not appreciate the two-part opening process for removing the cap and/or will not have the dexterity for the two-part opening process.

Another example of a childproof cap used for over-the-counter goods is a cap that requires a specific rotational alignment between the cap and the container before the cap can be pulled from the container to access the goods within the container. A discrete marking on the cap and a discrete marking on the container can indicate the proper rotational alignment. Again, the vast majority of children will not appreciate the markings and/or two-part process to remove the cap. One issue with these existing childproof caps is the complex shapes of the caps and respective features such as markings on the containers that necessitate an expensive manufacturing process such as injection molded plastic. This greatly increases the costs to produce the container and removable cap.

Another issue with existing childproof caps is the use of materials such as plastic to produce the complex shapes. Every year, eight million metric tons of plastic waste enters the world's oceans in addition to the 150 million metric tons of plastic waste already in the oceans. Moreover, plastics are typically only recyclable a few times before the physical properties of the plastic material degrade so much that the plastic material is not usable. Therefore, there is a need for a container and cap that are simple, cheap to manufacture, recyclable and yet childproof to prevent accidental consumption or handling of objects or goods stored in the container.

SUMMARY

The above shortcomings and other needs are addressed by the various embodiments and configurations described herein. One aspect of embodiments of the present disclosure is to provide a cap that is removable yet childproof. In one embodiment, a cap is positionable within a body, and the upper surface of the cap is devoid of edges or graspable surfaces to prevent a child from pulling the cap from the body. The cap has a two-part process to remove the cap to dissuade or confuse children from operating the cap. To operate the cap, a disc on top of the cap is first physically displaced downward past a lip and into the cap, which reveals a bottom surface of the lip. Then, a user can pull on the lip to remove the cap from the tubular body. A bias member in the cap exerts a force against the disc that must be overcome when a user presses the disc downward. This force is specifically chosen to be difficult for children to press but relatively easy for an adult to press. Embodiments of the present disclosure encompass bias members with linear or non-linear relationship between force and displacement.

A further aspect of embodiment of the present disclosure is provide a cap that is secured within a tubular body with an interference fit and friction force. When the cap is positioned in the tubular body, the friction must be great enough such that the cap does not fall out of the tubular body when the tubular body is inverted, dropped, etc. However, the friction force must not be so great that an adult cannot remove the cap from the tubular body by pulling on the bottom surface of the lip of the cap, as described above. Thus, in an unassembled state, the cap can have an outer diameter that is greater than an inner diameter of the tubular body. When the cap is positioned in the body, the cap can deflect the body to create the interference fit.

It is yet another aspect of embodiments of the present disclosure to provide a container system that is made from recycled materials and/or is recyclable itself. In some embodiments, the body is made from one or more paperboard tubes. The tubular body can comprise an inner tube positioned in an outer tube, where the upper end of the inner tube serves as a shoulder on which the cap contacts and rests upon. In addition, the body of the cap can be made from a paperboard tube. Other components described herein can also be made from a recyclable material or materials.

One particular embodiment of the present disclosure is a childproof container system, comprising a container having an inner surface that defines an interior volume, wherein the inner surface has an inwardly extending shoulder; a cap positionable in the interior volume of the container such that a lower end of the cap contacts the shoulder, and an outer surface of the cap forms an interference fit with the inner surface of the outer tube; an inwardly extending lip at an upper end of the cap that defines an opening into the cap; a disc positioned in the cap and biased against a bottom surface of the inwardly extending lip with a predetermined force, wherein the disc is configured to be pressed by a finger to overcome the predetermined force, and the inwardly extending lip is configured to receive a pulling force from a finger to overcome a friction force created by the interference fit and remove the cap from the container.

In some embodiments, the container comprises an outer tube extending from an upper end to a lower end, the outer tube defining an interior volume; and an inner tube positioned within the interior volume of the outer tube, wherein an upper end of the inner tube is offset from the upper end of the outer tube by a predetermined distance to form the shoulder. In various embodiments, the container and the cap are each made from a cellulose-based material. In some embodiments, the cellulose-based material is paperboard. In various embodiments, the system further comprises a bias member positioned in the cap to bias the disc against the bottom surface of the inwardly extending lip with the predetermined force, wherein the bias member is a foam material. In various embodiments, the disc has a stiffness that is greater than a stiffness of the bias member. In some embodiments, the opening has a circular cross section with an inner diameter that is less than an outer diameter of a circular cross section of the disc.

Another particular embodiment of the present disclosure is a childproof container system, comprising a paperboard outer tube extending from an upper end to a lower end, the outer tube defining an interior volume; a paperboard inner tube positioned within the interior volume of the outer tube, wherein an upper end of the inner tube is offset from the upper end of the outer tube by a predetermined distance; a paperboard cap positionable in the interior volume of the outer tube such that a lower end of the cap contacts the upper end of the inner tube, and an outer surface of the cap forms an interference fit with the inner surface of the outer tube; an inwardly extending lip at an upper end of the cap that is configured to receive a pulling force from a finger to overcome a friction force created by the interference fit and remove the cap from the outer tube.

In various embodiments, the system further comprises a disc positioned in the cap; and a bias member positioned in the cap to bias the disc against the bottom surface of the inwardly extending lip with a predetermined force, wherein the disc is configured to be pressed by a finger to overcome the predetermined force. In some embodiments, the predetermined force is at least 150 Newtons. In various embodiments, an outer diameter of the cap is greater than an inner diameter of the outer tube when the cap is removed from the outer tube to create the interference fit between the cap and the outer tube. In some embodiments, the outer diameter of the cap is at least 4 mils greater than an inner diameter of the outer tube. In various embodiments, a tape layer is at least partially wrapped around an outer surface of the cap. In some embodiments, a top surface of the cap and the inwardly extending lip has a rounded outer surface, and a top surface of the disc is flat.

A further particular embodiment of the present disclosure is a cap for a childproof container, comprising: a paperboard body extending from an upper end to a lower end, wherein a flange defines an opening at the upper end of the body, and the opening provides access to an interior volume of the body; a bias member positioned in the interior volume of the body; an upper member positioned in the interior volume of the body between the bias member and the flange, wherein, in an initial state, the bias member biases the upper member against the flange with a predetermined force, and wherein, in an actuated state, an external force overcomes the predetermined force to press the upper member away from the flange to allow a finger to enter the interior volume and pull on the flange to remove the cap from the paperboard body.

In some embodiments, the bias member is a foam material. In various embodiments, the upper member has a first rigidity that is greater than a second rigidity of the bias member. In some embodiments, the cap further comprises a retainer member position at a bottom end of the body to retain the bias member and the upper member in the interior volume of the body. In various embodiments, a lower end of the body is curled to form an inwardly extending lip to retain the bias member and the upper member in the interior volume of the body. In some embodiments, the paperboard body has a tubular shape with the opening at the upper end of the body, and a second opening at a lower end of the body. The body of the container can comprise paper, coated paper, laminated materials, foils, plastic or any combination thereof. The lower end of the body can be closed by a metal end, a film membrane, a plastic plug, a paper disc, laminated materials and/or crushed flat and sealed to provide an airtight container to protect the product from the outside environment.

In various embodiments, the system further comprises a protective film positioned on the inner surface of the container. In some embodiments, the system further comprises at least one of a second protective film, a label, or a printed paper positioned on an outer surface of the container. In various embodiments, the system further comprises a recessed film connected to the inner surface of the container and extending horizontally across the interior volume of the container to provide a seal within the container. In some embodiments, the system further comprises a tab on a top surface of the recessed film, wherein the tab is configured to be pulled with a predetermined force to break the connection between the recessed film and the inner surface of the container. In various embodiments, the system further comprises a film positioned on an upper surface of the container and extending across an upper opening of the container to provide a seal over the upper opening of the container.

In some embodiments, the system further comprises a tab connected to the film, wherein the tab is configured to be pulled with a predetermined force to break the connection between the film and the upper surface of the container. In various embodiments, the bias member comprises a bias body and a bias surface positioned on an upper surface of the bias body, wherein the bias body and the bias surface are made of the same material, and a density of the bias surface is greater than a density of the bias body. In some embodiments, the lower end of the cap contacts the shoulder via at least one intermediate layer. In various embodiments, the at least one intermediate layer is made from a wax material or a hot melt material.

A further particular embodiment of the present disclosure is a cap for a childproof container, comprising a body extending from an open upper end to a closed lower end, wherein an inwardly-extending flange defines an opening at the upper end of the body, and the opening provides access to an interior volume of the body; a bias member positioned in the interior volume of the body; an upper member positioned in the interior volume of the body between the bias member and the flange, wherein the upper member has a central portion offset from an outwardly-extending flange in a longitudinal direction of the body, wherein the central portion is positionable in the opening, and the outwardly-extending flange is configured to contact the inwardly-extending flange of the body, and wherein the upper member is configured to be pressed to compress the bias member, and move the outwardly-extending flange from the inwardly-extending flange.

In some embodiments, the bias member comprises a first helical member and a second helical member that intersect at least at one point, and the helical members compress to store mechanical energy. In various embodiments, the cap further comprises at least one fin extending from an outer surface of the body. In some embodiments, an upper surface of the at least one fin is smaller than a lower surface, and the surfaces are joined at an edge that is oriented toward the upper end of the body. In various embodiments, the cap further comprises a flange extending from an outer surface of the body proximate to the upper end of the body, wherein the flange is configured to contact an upper end of a container. In some embodiments, the cap further comprises a strip circumscribing at least a portion of an outer surface of the body, wherein the upper end of a container is configured to be positioned between the strip and the outer surface of the body, and wherein a tab is connected to the strip, and the tab is configured to be pulled to break the connection between the strip and the body.

Another particular embodiment of the present disclosure is a cap system for a childproof container, comprising a body having a substantially planar shape; a disc having a substantially planar shape; a bias member extending from a first connection with a lower surface of the body to a second connection with a lower surface of the disc, wherein a space is defined between the lower surfaces of the body and the disc and between the first and second connections; an inset extending into the bias member between the first and second connections; wherein, in a first position, the body and the disc are coplanar; and wherein, in a second position, a force applied to the disc moves the disc out of plane with the body and causes the bias member proximate to the inset to bend and accommodate the movement of the disc.

In various embodiments, the cap system further comprises a second inset extending into the bias member between the first and second connections, wherein the insets are positioned on opposing sides of the bias member. In some embodiments, the cap system further comprises a collar that has an inner surface that defines an interior volume, wherein the body and the disc define a common outer edge that is configured to be received into the interior volume.

Yet another particular embodiment of the present disclosure is a childproof container system, comprising a container having an inner surface that defines an interior volume, wherein the inner surface has an inwardly extending shoulder; a cap positionable in the interior volume of the container such that a lower end of the cap contacts the shoulder, and an outer surface of the cap forms an interference fit with the inner surface of the outer tube; an inwardly extending lip at an upper end of the cap that defines an opening into the cap; and a disc positioned in the cap and biased against a bottom surface of the inwardly extending lip with a predetermined force, wherein the disc is configured to be pressed by a finger to overcome the predetermined force, and the inwardly extending lip is configured to receive a pulling force from a finger to overcome a friction force created by the interference fit and remove the cap from the container.

In some embodiments, the container comprises an outer tube extending from an upper end to a lower end; and an inner tube positioned within the outer tube, wherein an upper end of the inner tube is offset from the upper end of the outer tube by a predetermined distance to form the shoulder. In some embodiments, the system further comprises a bias member positioned in the cap to bias the disc against the bottom surface of the inwardly extending lip with the predetermined force, wherein the bias member is a foam material, and the predetermined force is at least 150 Newtons. In various embodiments, the opening has a circular cross section with an inner diameter that is less than an outer diameter of a circular cross section of the disc. In some embodiments, the system further comprises a recessed film connected to the inner surface of the container and extending horizontally across the interior volume of the container to provide a seal within the container; and a tab on a top surface of the recessed film, wherein the tab is configured to be pulled with a predetermined force to break the connection between the recessed film and the inner surface of the container.

In various embodiments, the system further comprises a film positioned on an upper surface of the container and extending across an upper opening of the container to provide a seal over the upper opening of the container; and a tab connected to the film, wherein the tab is configured to be pulled with a predetermined force to break the connection between the film and the upper surface of the container. In some embodiments, the lower end of the cap contacts the shoulder via at least one intermediate layer, wherein the at least one intermediate layer is made from a wax material or a hot melt material. In various embodiments, an outer diameter of the cap is at least 4 mils greater than an inner diameter of the outer tube above the shoulder. In some embodiments, a tape layer is at least partially wrapped around an outer surface of the cap.

A further embodiment of the present disclosure is a cap for a childproof container, comprising a body extending from an upper end to a lower end, wherein a flange defines an opening at the upper end of the body, and the opening provides access to an interior volume of the body; a bias member positioned in the interior volume of the body; and an upper member positioned in the interior volume of the body between the bias member and the flange, wherein, in an initial state, the bias member biases the upper member against the flange with a predetermined force, and wherein, in an actuated state, an external force overcomes the predetermined force to press the upper member away from the flange to allow a finger to enter the interior volume and pull on the flange to remove the cap from a container.

In various embodiments, the upper member is an upper surface of the bias member, and the upper member and the bias member are made of the same material, and a density of the upper member is greater than a density of the bias member. In some embodiments, the upper member has a central portion offset from an outwardly-extending flange in a longitudinal direction of the body, wherein the central portion is positionable in the opening, and the outwardly-extending flange is configured to contact the flange of the body, and wherein the upper member is configured to be pressed to compress the bias member and move the outwardly-extending flange from the flange in the activated state.

In various embodiments, the bias member comprises a first helical member and a second helical member that intersect at least at one point, and the helical members compress to store mechanical energy. In some embodiments, the cap further comprises at least one fin extending from an outer surface of the body. In various embodiments, an upper surface of the at least one fin is smaller than a lower surface, and the surfaces are joined at an edge that is oriented toward the upper end of the body. In some embodiments, the cap further comprises a flange extending from an outer surface of the body proximate to the upper end of the body, wherein the flange is configured to contact an upper end of a container. In various embodiments, the cap further comprises a strip circumscribing at least a portion of an outer surface of the body, wherein the upper end of a container is configured to be positioned between the strip and the outer surface of the body, and wherein a tab is connected to the strip, and the tab is configured to be pulled to break the connection between the strip and the body.

Another particular embodiment of the present disclosure is a cap system for a childproof container, comprising a body having a substantially planar shape; a disc having a substantially planar shape; a bias member extending from a first connection with a lower surface of the body to a second connection with a lower surface of the disc, wherein a space is defined between the lower surfaces of the body and the disc and between the first and second connections; an inset extending into the bias member between the first and second connections; wherein, in a first position, the body and the disc are coplanar; and wherein, in a second position, a force applied to the disc moves the disc out of plane with the body and causes the bias member proximate to the inset to bend and accommodate the movement of the disc.

In various embodiments, the cap further comprises a second inset extending into the bias member between the first and second connections, wherein the insets are positioned on opposing sides of the bias member. In some embodiments, the cap further comprises a collar that has an inner surface that defines an interior volume, wherein the body and the disc define a common outer edge that is configured to be received into the interior volume.

The Summary is neither intended nor should it be construed as being representative of the full extent and scope of the present disclosure. Embodiments are set forth in various levels of detail in the Summary as well as in the attached drawings and the Detailed Description and no limitation as to the scope of the present disclosure is intended by either the inclusion or non-inclusion of elements or components. Additional aspects of the container system and methods of use will become more readily apparent from the Detailed Description, particularly when taken together with the drawings.

The above-described embodiments, objectives, and configurations are neither complete nor exhaustive. As will be appreciated, other embodiments are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary, brief description of the drawings, detailed description, abstract, and claims themselves.

BRIEF DESCRIPTION OF THE DRAWINGS

The accompanying drawings, which are incorporated in and constitute a part of the specification, illustrate embodiments of the container system and together with the Summary given above and the Detailed Description of the drawings given below, serve to explain the principles of these embodiments. In certain instances, details that are not necessary for an understanding of the container system or that render other details difficult to perceive may have been omitted. It should be understood, of course, that the container system is not necessarily limited to the particular embodiments illustrated herein. Additionally, it should be understood that the drawings are not necessarily to scale.

Figure 1A:
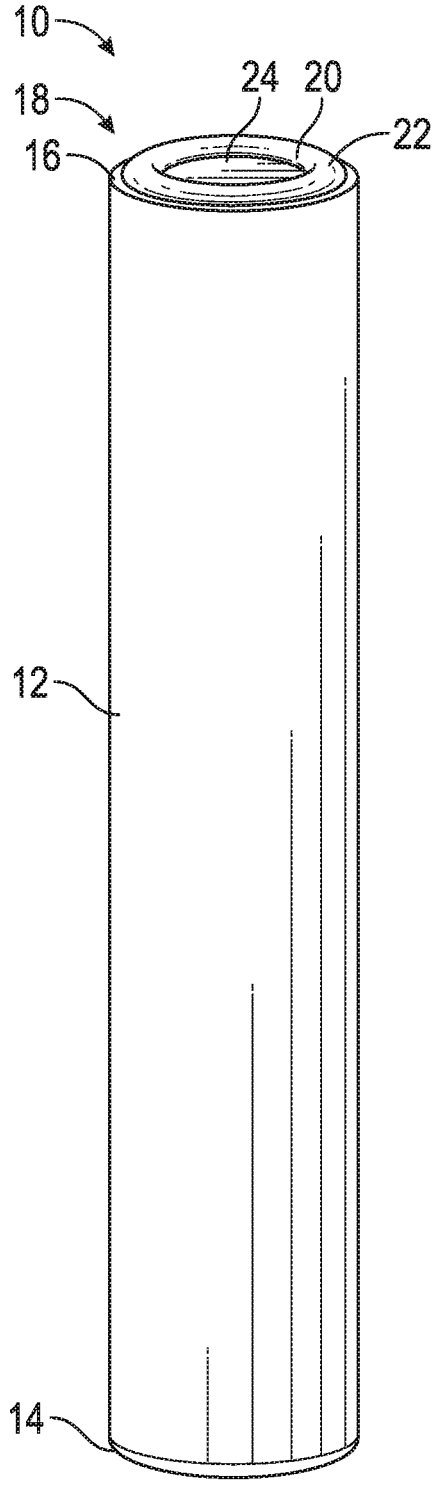
FIG. 1A is a perspective view of a container system with a removable cap in accordance with one embodiment of the present disclosure.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 10 | Container |
| 12 | Outer Tube |
| 14 | Lower End |
| 16 | Upper End |
| 18 | Cap |
| 20 | Lip |
| 22 | Upper Surface |
| 24 | Disc |
| 26 | Inner Surface |
| 28 | Bottom Member |
| 30 | Interior Volume |
| 32 | Inner Tube |
| 34 | Lower End |
| 36 | Upper End |
| 38 | Outer Surface |
| 40 | Offset Distance |
| 42 | Bottom Surface |
| 44 | Retainer Member |
| 46 | Bias Member |
| 48 | Outer Surface |

-continued

| Number | Component |
|---|---|
| 50 | Opening |
| 52 | Interior Volume |
| 54 | Tube |
| 56 | Shoulder |
| 58 | Recessed Film |
| 60 | Tab |
| 62 | Inner Film |
| 64 | Top Film |
| 66 | Tab |
| 68 | Bias Body |
| 70 | Bias Surface |
| 72a, 72b | Layers |
| 74 | Outer Flange |
| 76 | Outer Flange |
| 78 | First Member |
| 80 | Second Member |
| 82 | Fin |
| 84 | Upper Surface |
| 86 | Lower Surface |
| 88 | Peel Strip |
| 90 | Connection |
| 92 | Tab |
| 94 | Body |
| 96 | Collar |
| 98 | Space |
| 100 | Inset |
| 102 | Hinge |

DETAILED DESCRIPTION

The container system has significant benefits across a broad spectrum of endeavors. It is the Applicant's intent that this specification and the claims appended hereto be accorded a breadth in keeping with the scope and spirit of the disclosure despite what might appear to be limiting language imposed by the requirements of referring to the specific examples disclosed. To acquaint persons skilled in the pertinent arts, a preferred embodiment that illustrates the best mode now contemplated for putting the container system into practice is described herein by, and with reference to, the annexed drawings that form a part of the specification. The exemplary embodiment is described in detail without attempting to describe all of the various forms and modifications in which the container system might be embodied. As such, the embodiments described herein are illustrative, and as will become apparent to those skilled in the arts, may be modified in numerous ways within the scope and spirit of the disclosure.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments are described herein and as depicted in the drawings. It is expressly understood that although the figures depict container systems, caps, and methods and systems for using the same, the present disclosure is not limited to these embodiments.

Referring now to FIG. 1A, a container 10 that has a selectively removable cap 18 is provided. In this embodiment, the container 10 has an outer tube 12 that extends from a lower end 14 to an upper end 16. The outer tube 12 in this embodiment is preferably made from a paperboard material that has been recycled and/or is recyclable itself. However, it will be appreciated that the outer tube 12 and other components described herein can be made from any material, including plastic.

Next, a cap 18 is positioned in the upper end 16 of the container 12. The cap 18 in this embodiment has an inwardly extending lip 20 with a top surface 22, and the cap 18 has a disc 24 positioned below the lip 20. As described in greater detail below, the lip 20 and the disc 24 work together to prevent a child from removing the cap 18 from the container 10 and accessing potentially hazardous contents within the container 10. As shown, the top surface 22 of the lip 20 is rounded from an outer edge to an inner edge to provide a substantially smooth or continuous top surface 22 that transitions to the flat disc 24. This arrangement reduces or eliminates the surfaces or edges that a child could grasp or manipulate to remove the cap 18 from the container 10.

Figure 1B:
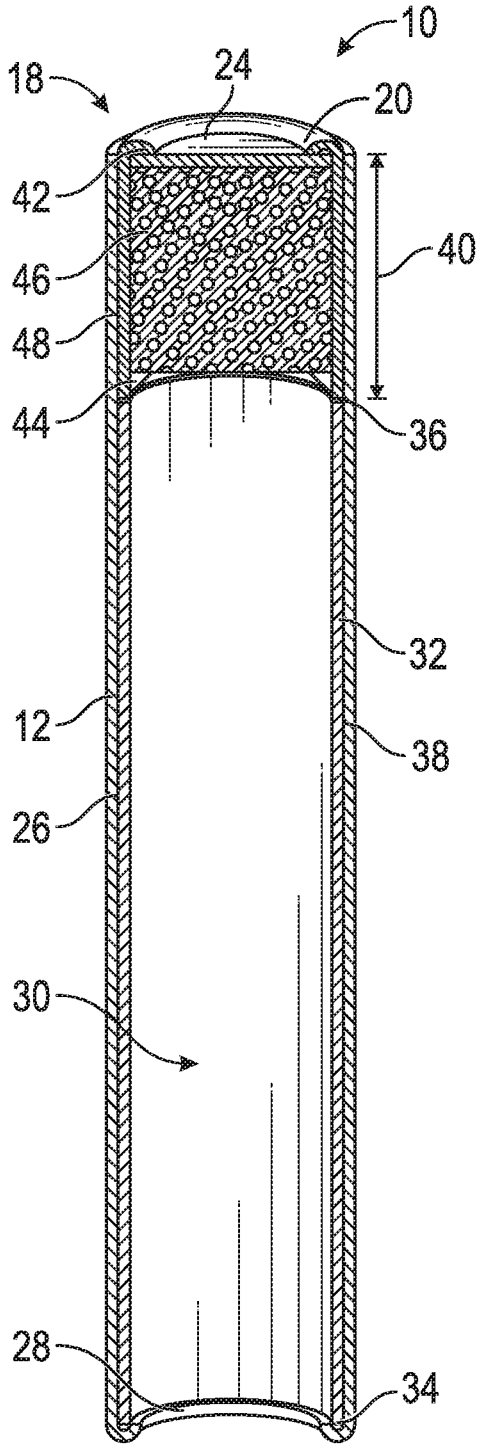
FIG. 1B is a cross-sectional elevation view of a container system with a cap in a first state in accordance with one embodiment of the present disclosure.
Figure 1C:
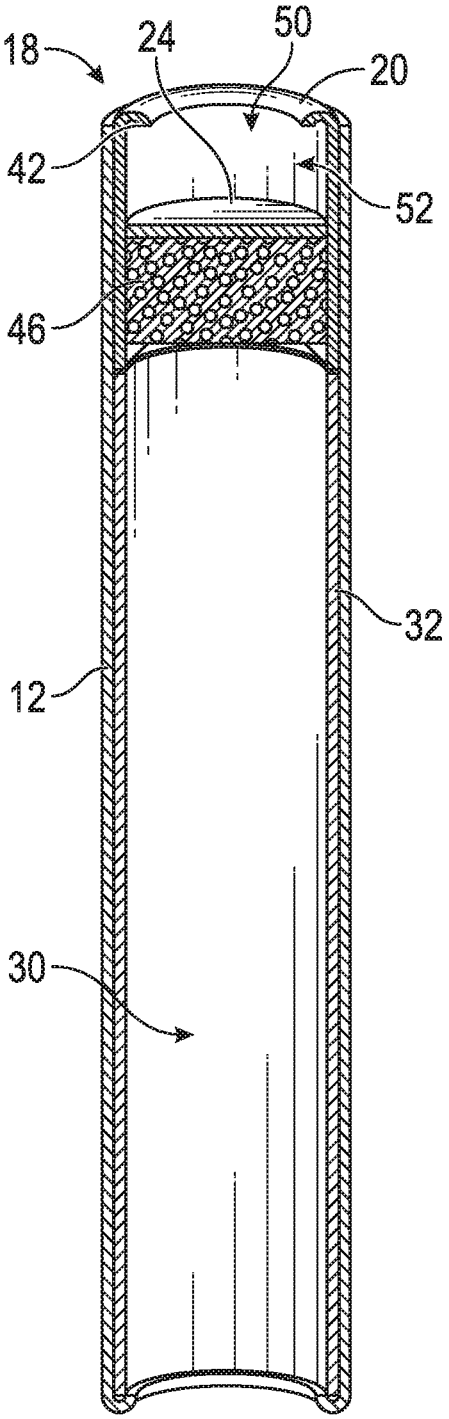
FIG. 1C is a cross-sectional elevation view of the container system in FIG. 1B with the cap in a second, depressed state in accordance with one embodiment of the present disclosure.

Referring now to FIGS. 1B and 1C, cross-sectional elevation views of the container 10 in a first state and a second state are provided, respectively. In FIG. 1B, the outer tube 12 has an inner surface 26 and a bottom member 28 that define an interior volume 30 of the outer tube 12. The bottom member 28 can be an inwardly extending lip, a dome, a disc, a flat member, or other similar shaped member. Next, an inner tube 32 is positioned within the interior volume 30 of the outer tube 12. The inner tube 32 extends from a lower end 34 to an upper end 36, and an outer surface 38 of the inner tube 32 is proximate to or contacts the inner surface 26 of the outer tube 12. The upper end 36 of the inner tube 32 is offset from the upper end 16 of the outer tube 12 by a predetermined distance 40. This offset distance 40 provides space within the outer tube 12 for the cap 18 to reside and enclose the interior volume 30 of the outer tube 12, and more broadly, the container 10.

The cap 18, as noted above, has an inwardly extending lip 20, a disc 24, and a generally annular shape. As shown in FIG. 1B, the outer diameter of the disc 24 is greater than the inner diameter defined by the lip 20. Therefore, the disc 24 can contact a bottom surface 42 of the lip 20 but not pass the lip 20. In addition, a bias member 46 is positioned in the cap 18 between the disc 24 and a retainer member 44 that retains the bias member 46 within the cap 18. The bias member 46 is configured to exert a force against the disc 24 to press the disc 24 against the lip 20. It will be appreciated that in some embodiments, the disc 24 is partially and/or hingedly connected to the lip 20 to secure the positioned of the disc 24 relative to the lip 20.

During operation, a user must depress the disc 24 and overcome this force to access the bottom surface 42 of the lip 20 to pull on the bottom surface 42 and remove the cap 18 from the outer tube 12. The force of the bias member 46 is selected such that a child cannot easily overcome the force and remove the cap 18. The amount of force that can be exerted by an average adult, approximately 249 Newtons, is roughly an order of magnitude greater than the amount of force that can be exerted by an average child of four years old, which is approximately 42.1 Newtons. Thus, the force exerted by the bias member 46 against the disc 24 and lip 20 can be at least 150 Newtons in some embodiments, considering that 42.1 Newtons is the amount of force exerted by an average child. In some embodiments, the force exerted by the bias member 46 is at least 200 Newtons. In various embodiments, the force exerted by the bias member is between 100 and 200 Newtons.

A variety of bias members 46 are encompassed by embodiments of the present disclosure. FIG. 1B shows a foam material that serves as a bias member 46. As described in detail below, the foam material is physically compressed between the disc 24 and the retainer member 44 in the cap 18. The material of the bias member 46, in various embodiments, can be selected to be a recyclable material. Moreover, other bias member 46 are contemplated such as coil springs, air springs, etc. It will also be appreciated that in this and other embodiments, the bias member 46 and/or other components can be impregnated with materials to serve a variety of functions. For instance, the bias member 46 can be impregnated with silica, activated charcoal, calcium sulfate, and/or calcium chloride to keep the cap and/or other components dry.

FIG. 1C shows the cap 18 in a second state as opposed to a first state in FIG. 1B. As shown, the disc 24 has been depressed and the bias member 46 has been compressed with sufficient force such that a finger of the user can extend through an opening 50 defined by the lip 20, into an interior volume 52 of the cap 18 can contact the bottom surface 42 of the lip 20 to then pull the cap 18 out of the outer tube 12. With a foam bias member 46, the first state and second states can be characterized in terms of physical size where the foam bias member 46 is compressed into a smaller size in the second state. In addition, the foam bias member 46 has cells that define voids within the foam bias member 46, and the foam bias member 46 can have a void fraction or ratio between the void portions and non-void portions of the foam bias member 46. Thus, the foam bias member 46 has a smaller void fraction when compressed in the second state. It will be appreciated that the foam bias member 46 can comprise an open cell foam, a closed cell foam, or any other type of foam or material.

Figure 1D:
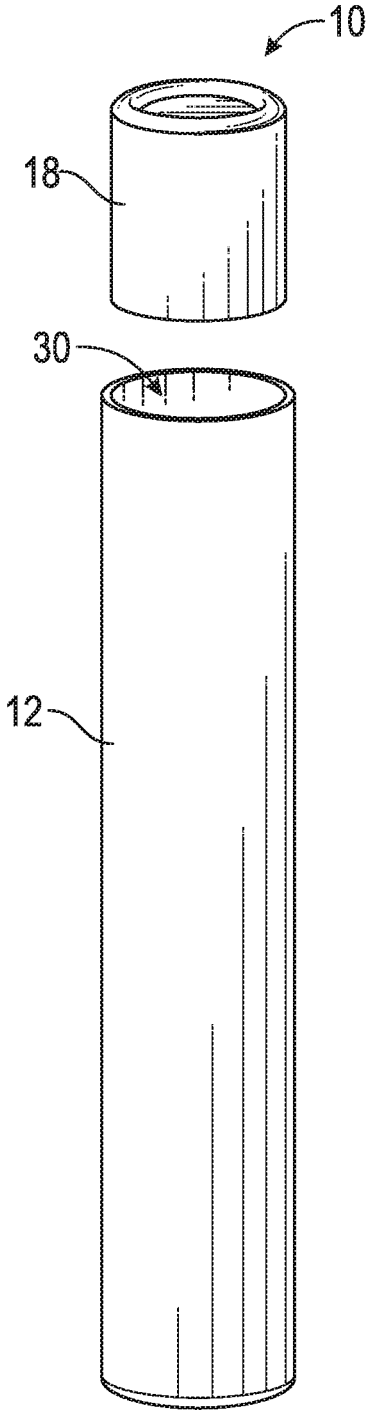
FIG. 1D is a perspective view of a container system with a cap removed from an outer tube in accordance with one embodiment of the present disclosure

FIG. 1D shows the cap 18 removed from the outer tube 12 to provide access to the interior volume 30 of the outer tube 12 and the contents therein. Referring back to FIG. 1B, an outer surface 48 of the cap 18 creates an interference fit with the inner surface 26 of the outer tube 12. Like the force of the bias member 46, the force required to overcome the friction of the interference fit is given consideration. The force must be great enough such that the cap 18 does not fall out of the outer tube 12 when the container 10 is inverted upside down. Moreover, the force must be great enough such that the cap 18 does not fall out of the outer tube 12 when container 10 is rapidly manipulated or dropped. Similarly, the force must be reasonably less than the pull force exerted by a finger contacting the bottom surface 42 of the lip 20. This force can be accomplished by sizing the outer diameter of the cap 18 to be the same size as the inner diameter of the outer tube 12. Then, a material, such as tape, can be wrapped around the outer surface of the cap 18 in one or more plys. The average thickness of tape can be between approximately 1 to 6 mils, or thousands of an inch. Thus, a single ply wrapped around the outer surface of the cap 18 would add between approximately 2 to 12 mils to the diameter of the cap 18. Two plys wrapped around the outer surface of the cap 18 would add between approximately 4 to 24 mils to the diameter of the cap 18. Alternatively or in combination, the diameter of the cap 18 can be increased over the inner diameter of the outer tube 12. Stated differently, in a non-assembled state, the cap 18 has an outer diameter that is greater than an inner diameter of the outer tube 12.

The embodiments of the container 10 described herein can be manufactured in a number of ways. First, the outer tube 12 is formed and has a tubular shape. The lower end 28 of the outer tube 12 can be curled, or a bottom plate, flange, disc or other similar component can be positioned at the lower end 28 of the outer tube 12 to establish the bottom end of the container 10 and enclose the interior volume 30 of the container 10. Then an inner tube 32 can be positioned within the outer tube 12. A simple friction fit can join the two tubes 12, 32, but it will be appreciated that other ways of joining two components are contemplated such as adhesive.

Next, the cap 18 can also be manufactured according to a particular sequence according to one embodiment. First, the cap 18 is a tubular shape, and the upper end is curled to form the inwardly extending lip 20. Then, a disc 24 is inserted into the interior of the cap 18, and the bias member 46 is positioned against the disc 24 within the cap 18. Lastly, a retainer member 44 is fixed at a lower end of the cap 18 to hold the disc 24 and bias member 46 within the cap 18. The retainer member 44 can be, for example, fixed in place with an adhesive or pin. However, it will be appreciated that the retainer member 44 can be fixed in any number of ways, and the cap 18 can be assembled in any number of ways. For instance, in an alternative embodiment, once the disc 24 and the bias member 46 are positioned in the cap 18, the bottom end of the cap 18 can be curled to form another inwardly extending lip that retains the disc 24 and the bias member 46 within the cap 18.

Figure 2:
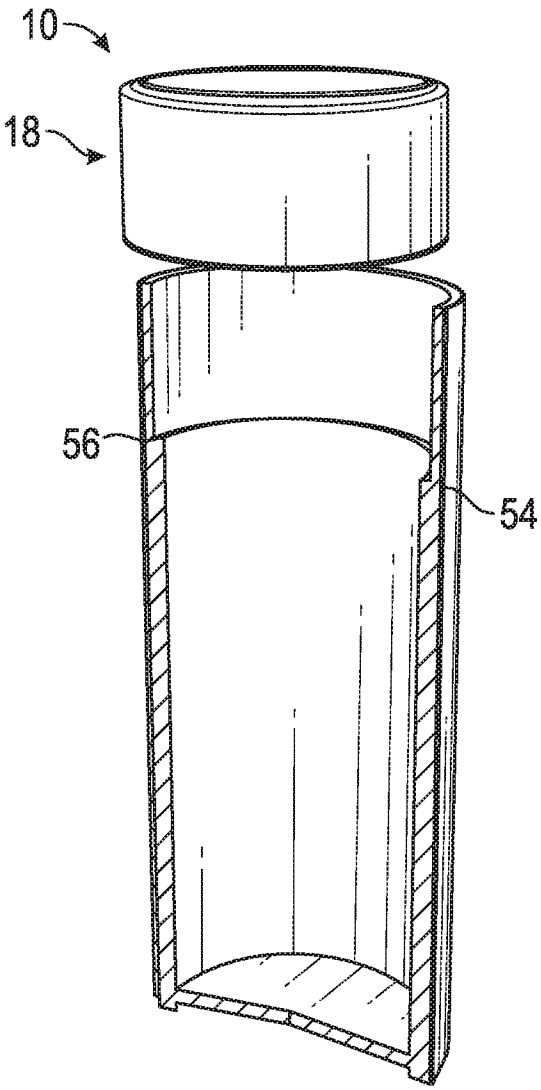
FIG. 2 is a cross-sectional, perspective view of a container system with a cap removed from a body in accordance with one embodiment of the present disclosure.

FIG. 2 shows a cross-sectional, perspective view of a container 10 with a cap 18 removed. As shown, a single tube 54 forms the body of the container 10, and a shoulder 56 is formed into an inner surface of the tube 54. The shoulder 56 is substantially horizontal, and the inner surface of the tube 54 has a larger diameter above the shoulder 56 than below the shoulder 56. The outer diameter of the cap 18 is greater than the inner diameter of the tube 54 below the shoulder 56. Thus, as the cap 18 is positioned into the tube 54, the cap 18 contacts and rests upon the shoulder 56. In this embodiment, and in any other embodiment described herein, the tube 54 can be formed or molded from plastic. In addition, it will be appreciated that the terms "container", "body", and/or "tube" can be used interchangeably, and can also hold different meanings in some embodiments.

Figure 3:
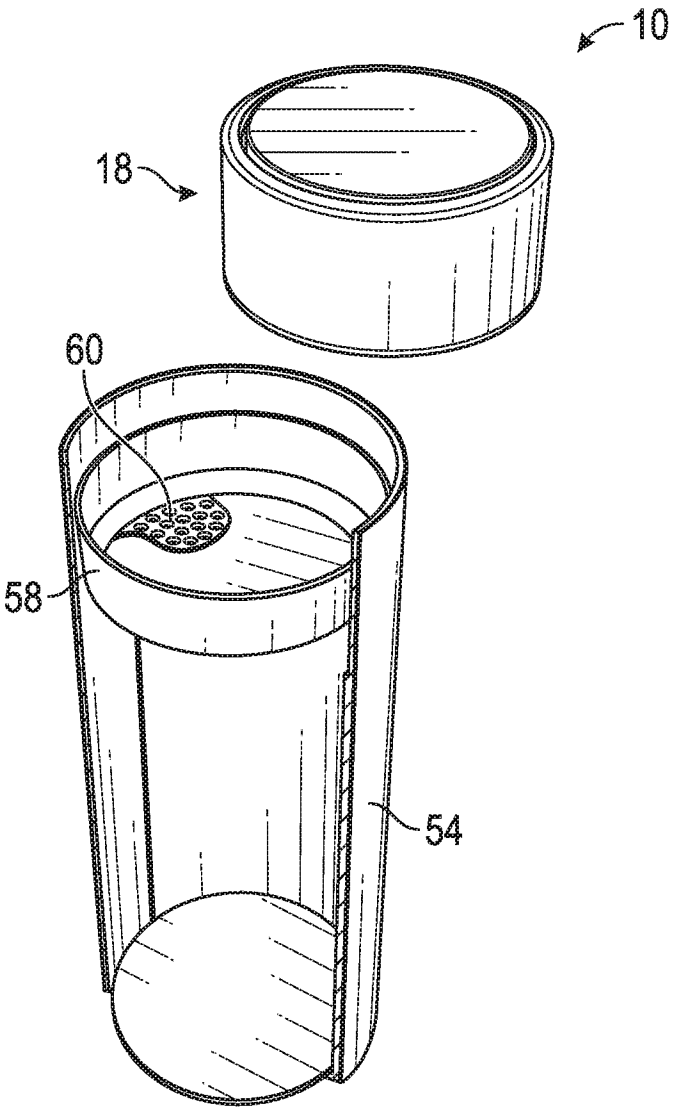
FIG. 3 is a cross-sectional perspective view of a container system with a recessed film in accordance with one embodiment of the present disclosure.

FIG. 3 is a cross-sectional perspective view of a container 10 with a cap 18 and a recessed film 58 with a tab 60. The recessed film 58 is positioned in the tube 54 and continuously spans a cross-sectional area within the tube 54 to seal contents within the tube 54. The recessed film 58 is shaped to conform to the inner surface of the tube 54 such that the recessed film 58 can partially receive the cap 18. This allows for the long-term storage of contents with the tube 54. Then, during an initial use, a user removes the cap 18, and then pulls on the tab 60 to remove the recessed film 58, and the cap 18 can then be positioned in the tube 54 to enclose the contents within the tube 54.

Figure 4A:
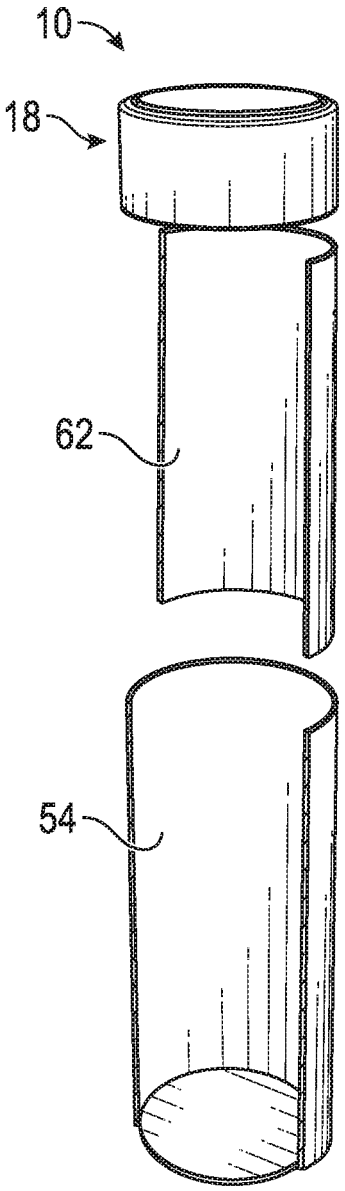
FIG. 4A is a cross-sectional, perspective exploded view of a container system with an inner film in accordance with one embodiment of the present disclosure.
Figure 4B:
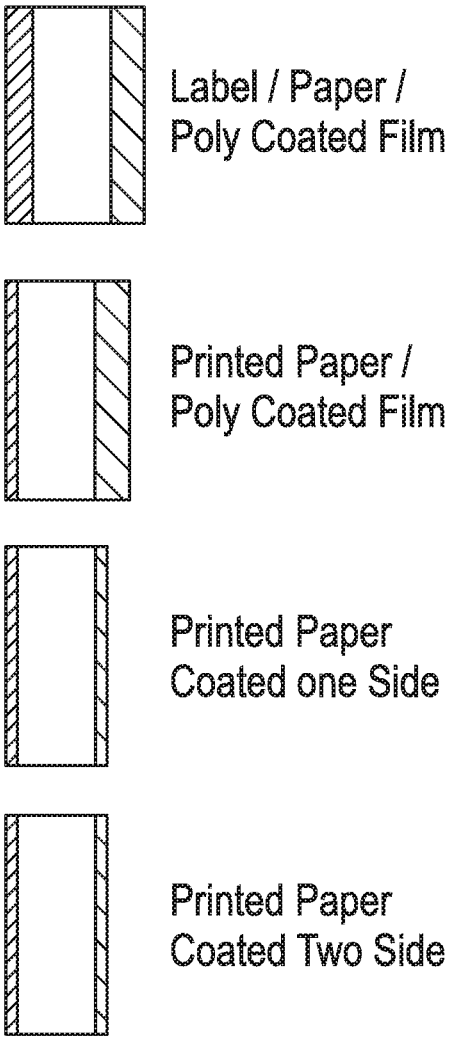
FIG. 4B is a cross-sectional, elevation view of a body of a container system in accordance with at least one embodiment of the present disclosure.

FIGS. 4A and 4B show cross-sectional views of the container 10 and a portion of the tube 54 of the container 10, respectively. As shown, the tube 54 can include a protective inner film 62 to provide a layer of protection from contents within the container 10 and/or the environment outside of the container 10. The tube 54 can be made from a cellulose-based material that can be potentially damaged by contents or an external environment. As such, a poly-coated film made from, for example, polyethylene can provide protection against such contents or environment. As shown in FIG. 4B, a cross-section of part of the container 10 can include any combination of a label, the tube 54, and a protective film 62.

Figure 5A:
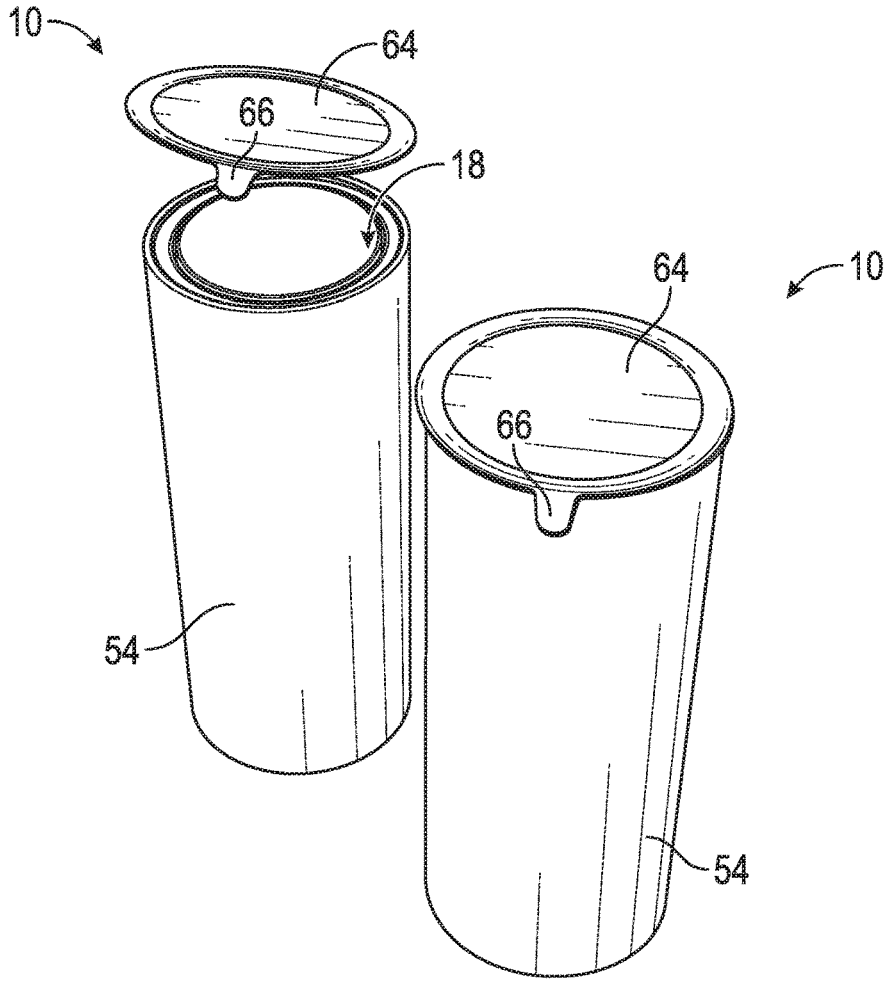
FIG. 5A is a perspective view of a container system with a top film in a first position and a second position in accordance with one embodiment of the present disclosure.
Figure 5B:
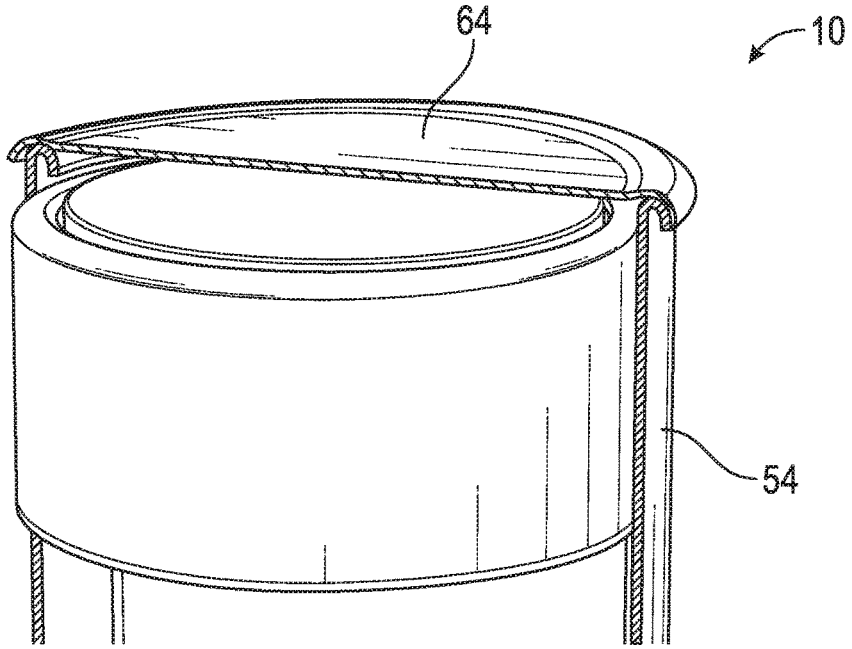
FIG. 5B is a partial cross-sectional, perspective view of a container system with a top film in accordance with one embodiment of the present disclosure.

FIGS. 5A and 5B show various views of a container 10 with a removable top film 64 and associated tab 66. Similar to the embodiment in FIG. 3, the top film 64 can seal the enclosed volume within the container 10. However, the top film 64 also seals the cap 18. During a first use, a user can pull a tab 66 of the film 64, and peel or remove the film 64 from the container 10. Then the user can remove the cap 18 to access contents within the container 10. The films described herein can be adhered to an edge or surface to hermetically seal the volume within the container 10. For instance, in FIGS. 5A and 5B, the top film 64 is adhered to a top surface of edge the tube 54. In some embodiments, part of the top film 64 is permanently adhered to part of the top surface to serve as a type of hinge such that a user can pull a tab of the film 64, access the cap 18 or contents, and then re-seal the film 64 onto the tube of the container 10.

Figure 6:
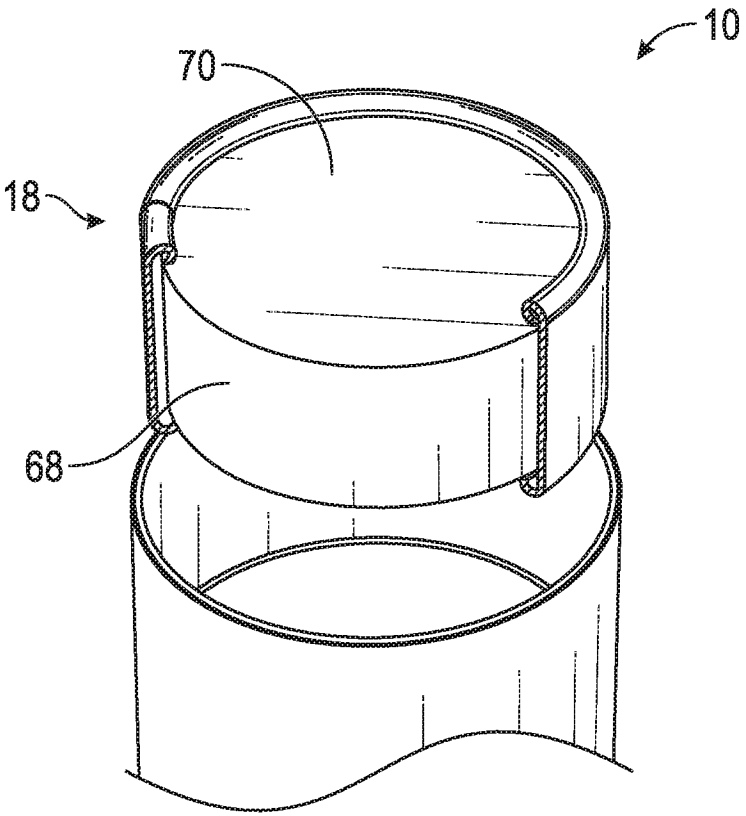
FIG. 6 is a perspective view of a container system with a bias member with a densified top surface in accordance with one embodiment of the present disclosure.

FIG. 6 shows an embodiment of the container 10 with a cap 18 and a combined bias member and disc that can be described as a bias member having a bias body 68 and a bias surface 70. The bias body 68 and the bias surface 70 can be made of the same material where the bias surface 70 has a higher density than the bias body 68. Thus, the bias surface 70 can distribute forces from, for instance, a finger over a larger area, and then the bias body 68 can compress in response to those forces. The bias surface 70 and the bias body 68 can be made in a number of ways. In some embodiment, a surface treatment is applied to a single material to create the bias surface 70 and the non-treated portion of the material serves as the bias body 68. In other embodiments, the bias surface 70 is adhered or otherwise combined with the bias body 68.

Figure 7:
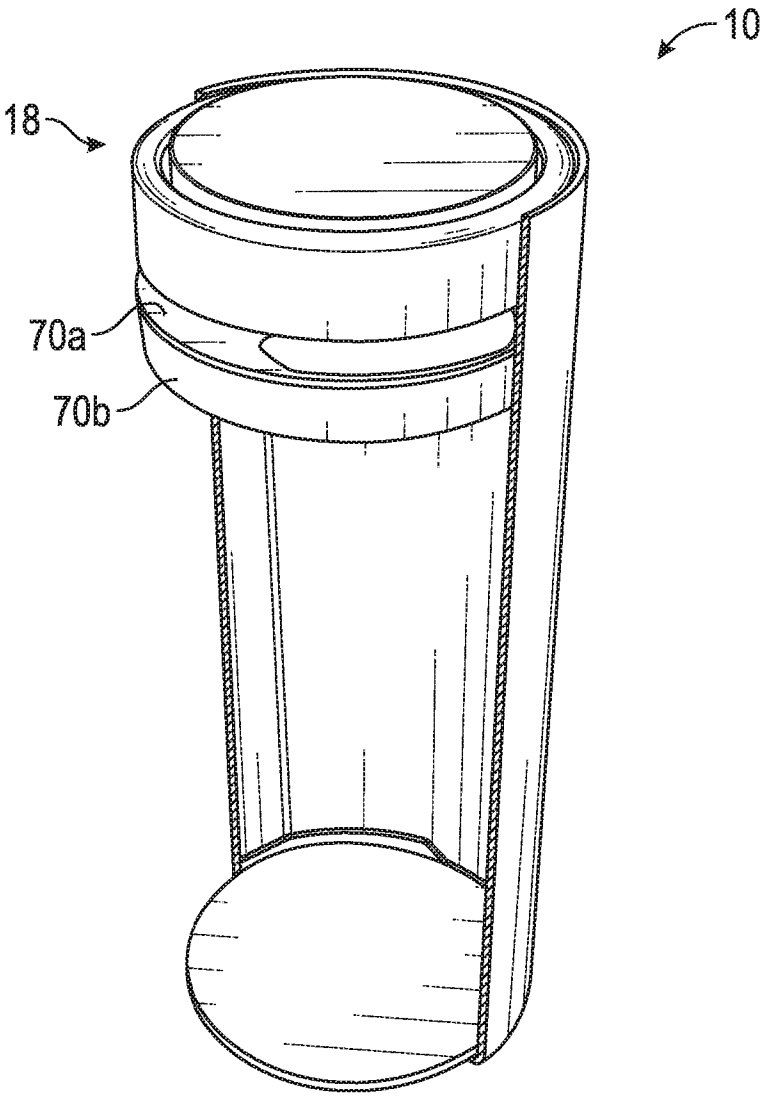
FIG. 7 is cross-sectional perspective view of a container system with a cap and multiple intermediate layers in accordance with one embodiment of the present disclosure.

FIG. 7 shows an embodiment of the container 10 that has a cap 18 with multiple layers 70*a*, 70*b*. In some embodiments, the layers 70*a*, 70*b* are adhered to a bottom of the cap 18 to change the position of the cap 18 relative to the body of the container 10 along a longitudinal axis. In other embodiments, the layers 70*a*, 70*b* are positioned in or connected to the tube of the container 10. The layers 70*a*, 70*b* can be hotmelt or wax, and moreover, the layers 70*a*, 70*b* can serve other functions such as sealing. It will be appreciated that the cap 18 can have one layer or more than two layers.

Figure 8A:
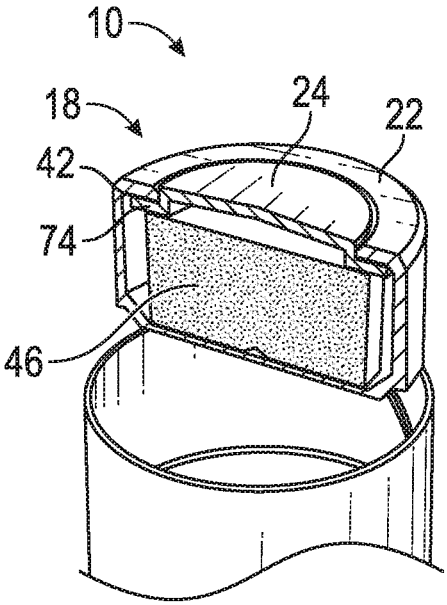
FIG. 8A is a cross-sectional perspective view of a container system with a cap having a disc with an outer flange in accordance with one embodiment of the present disclosure.

FIG. 8A shows an embodiment of the container 10 with a disc 24 that has a central portion that is offset along a longitudinal axis from an outer flange 74. Thus, the central portion is positioned flush with an upper surface 22 of the cap 18 to help prevent an unintentional removal of the cap 18. The outer flange 74 extends outward in a radial direction to contact a bottom surface 42 of the cap 18 and keep the disc 24 retained within the cap 18. This bottom surface 42 is the bottom surface of an inwardly-extending flange that defines an upper opening in which the central portion is positioned. A user can press the disc 24 to compress the bias member 46 and grip the bottom surface 42 as described elsewhere herein. It will be appreciated that while a round shape is depicted, the cap 18 and disc 24 in this embodiment and other embodiments can be any shape.

Figure 8B:
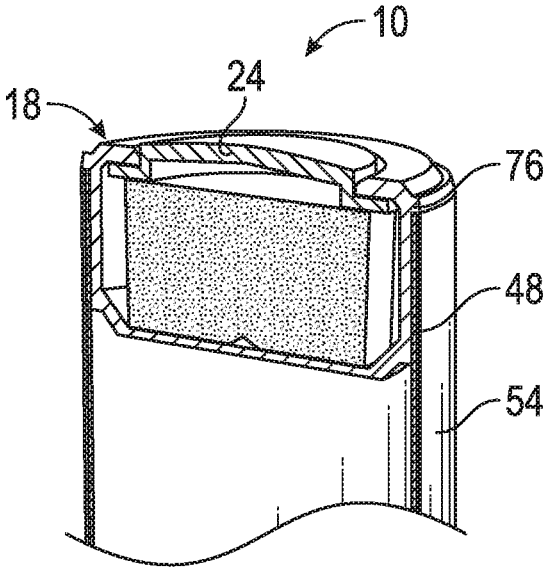
FIG. 8B is a cross-sectional perspective view of a container system with a cap having an outer flange in accordance with one embodiment of the present disclosure.

FIG. 8B shows an embodiment of the container 10 that has a cap 18 with an outer flange 76 extending outwardly and positioned proximate to an upper surface of the cap 18. This outer flange 76 can be used in lieu of a shoulder within the tube of the container 10 to limit movement of the cap 18 relative to the tube. When inserting the cap 18 into the tube, the flange 76 contacts an upper surface of the tube to locate the cap 18 relative to the tube. Moreover, the flange 76 can extend in a radial direction to be flush with an outer surface of the tube of the container 10 such that the cap 18 is not easily graspable by a user.

Figure 9:
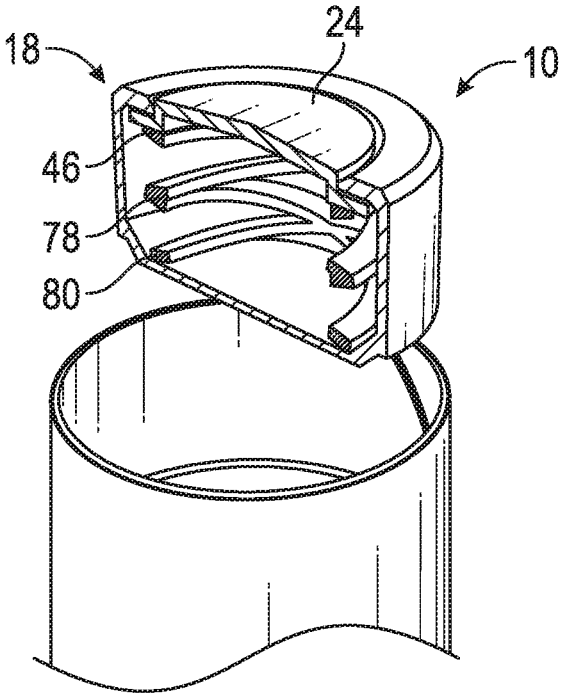
FIG. 9 is a cross-sectional perspective view of a container system with a bias member with helical components in accordance with one embodiment of the present disclosure.

FIG. 9 shows an embodiment of the container 10 with a disc 24 and a bias member 46 that has first component 78 and a second component 80. Each component 78, 80 extends in a helical manner between a disc 24 and a bottom surface of the cap 18. One component 78 extends turning in one direction, and the other component extends turning in the opposing direction. The components 78, 80 can intersect at one or more points along the helical shapes and can be formed by an additive manufacturing process. Together, the first and second components 78, 80 form a bias member 46 that provides a force in response to displacement of the disc 24 and compression of the bias member 46.

Figure 10:
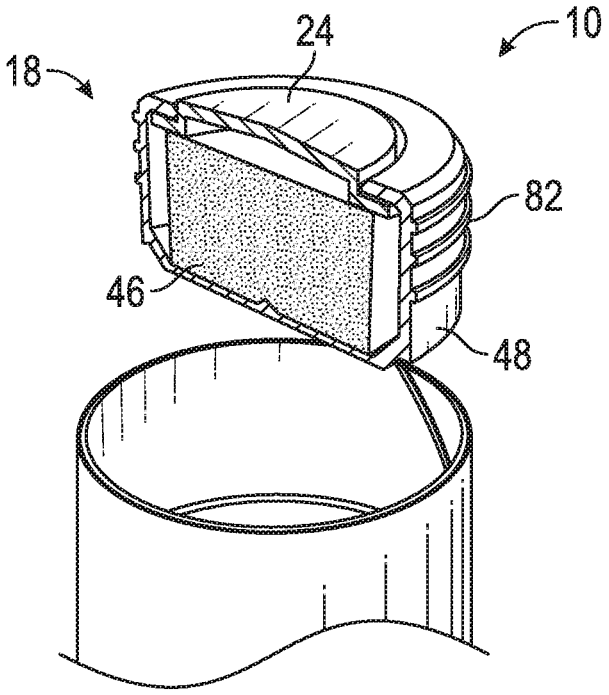
FIG. 10 is a cross-sectional perspective view of a container system with a cap having an outer fin in accordance with one embodiment of the present disclosure.

FIG. 10 shows an embodiment of the container 10 with fins 82 extending from an outer surface 48 of the cap 18. The fins 82 can provide an interference fit with the inner surface of the tube of the container 10. As shown, three fins 82 each extend about a perimeter of the outer surface 48. It will be appreciated that the present disclosure encompasses embodiments with greater or fewer numbers of fins 82 and fins 82 that do not continuously extend about the outer surface 48.

Figure 11:
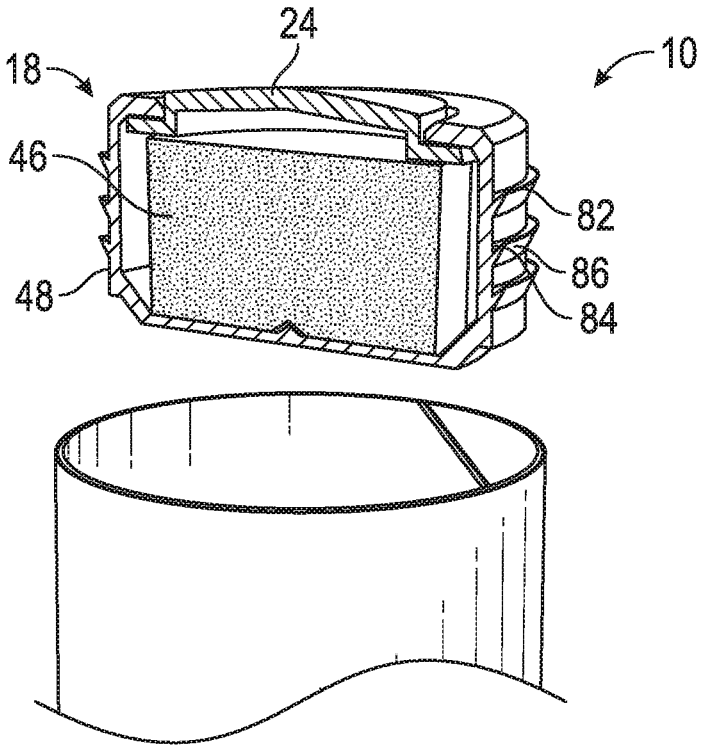
FIG. 11 is a cross-sectional perspective view of a container system with a cap having another outer fin in accordance with one embodiment of the present disclosure.

FIG. 11 shows an embodiment of the container 10 that also has fins 82 but with a different cross-sectional shape. The fins 82 in FIG. 10 have a half-circle, cross-sectional shape with the top surface generally mirroring the bottom surface about a horizontal plane. In contrast, the fins 82 in FIG. 11 have a top surface 84 that is shorter than a bottom surface 86 to provide upwardly-sloped fins 82. This shape allows the fins 82 to easily enter the tube of the container 10 and then grip the inner surface of the tube as a user tries to remove the cap 18. This difference in friction force between entering the tube and exiting the tube helps reduce the likelihood of an unintentional removal of the cap 18 from the tube.

Figure 12A:
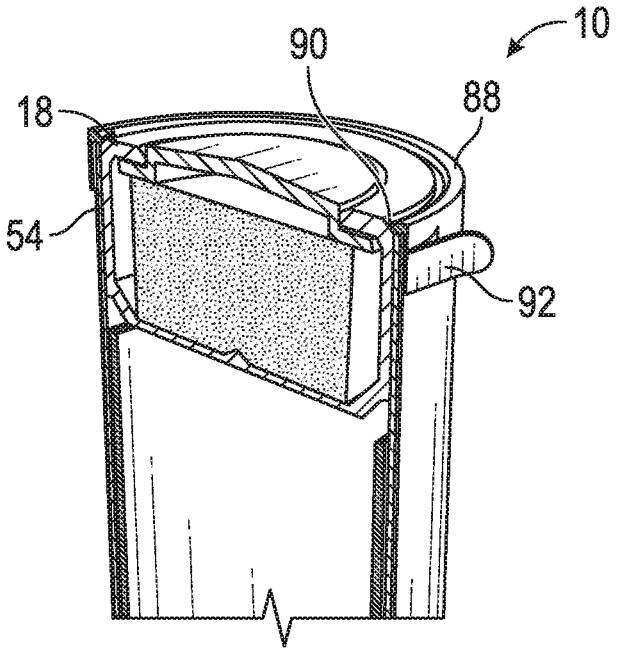
FIG. 12A is a cross-sectional perspective view of a container system with a peelable strip on a cap in accordance with one embodiment of the present disclosure.
Figure 12B:
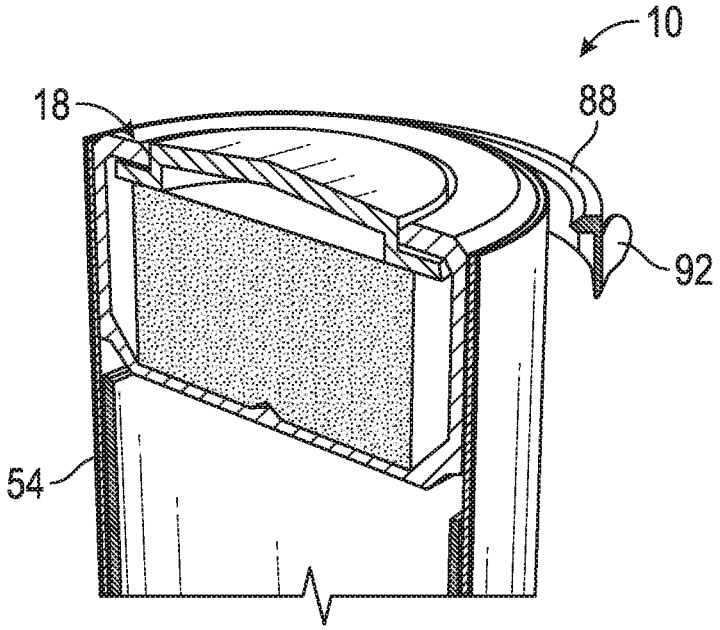
FIG. 12B is a cross-sectional perspective view of a container system with a peelable strip partially removed from a cap in accordance with one embodiment of the present disclosure.

FIGS. 12A and 12B show an embodiment of the container 10 with a peelable strip 88 that has a selective connection 90 with part of the cap 18. In an initial state as shown in FIG. 12A, the strip 88 secures the cap 18 to the body or tube 54. The strip 88 can impose a friction force or interference fit against an outer surface of the tube 54. Then, as shown in FIG. 12B, a user can pull a tab 92 to break the connection 90 between the strip 88 and the cap 18. Once the strip 88 is removed, the cap 18 and tube 54 can operate as described elsewhere herein.

Figure 13A:
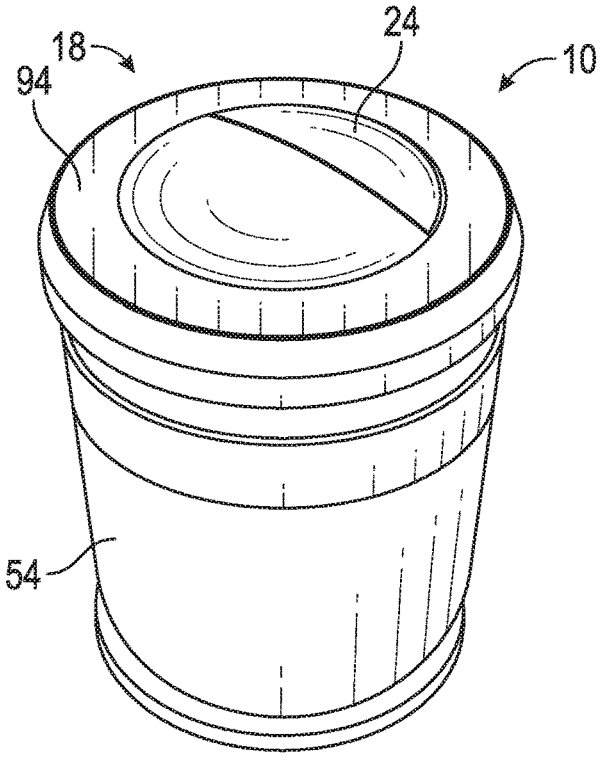
FIG. 13A is a perspective view of a container system with a removable cap in a container in accordance with one embodiment of the present disclosure.
Figure 13B:
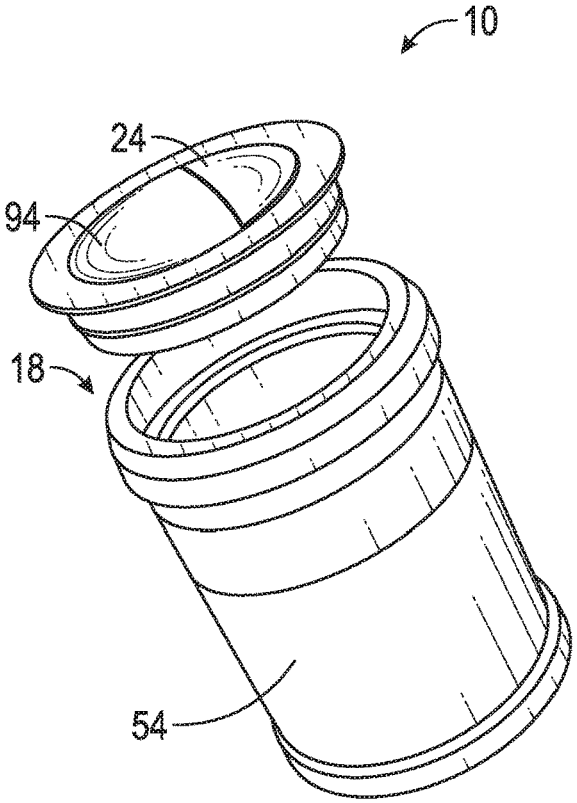
FIG. 13B is a perspective view of the container system in FIG. 13A with a removable cap out of a container in accordance with one embodiment of the present disclosure.

FIGS. 13A and 13B show perspective views of a container 10 with a cap 18 where a disc 24 partially covers an upper area or surface of the cap 18. In FIG. 13A, the cap 18 is in an initial state, and then in FIG. 13B, the disc 24 is pressed inward relative to a body 94 of the cap 18 to expose an edge or surface for a user to grasp and remove the cap 18 from the body or tube of the container 10.

Figure 14A:
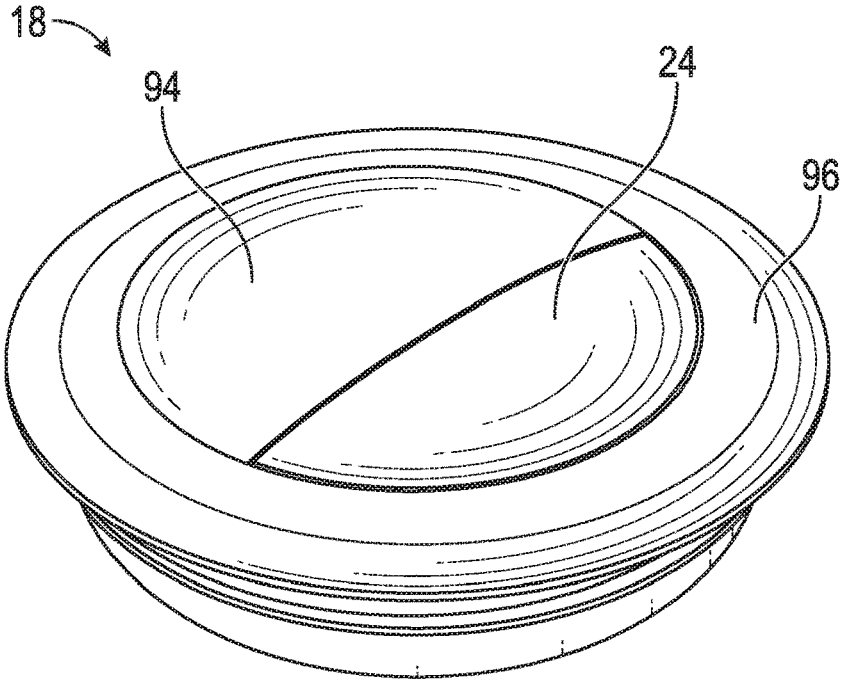
FIG. 14A is a perspective view of a container system with a removable cap in a collar in accordance with one embodiment of the present disclosure.
Figure 14B:
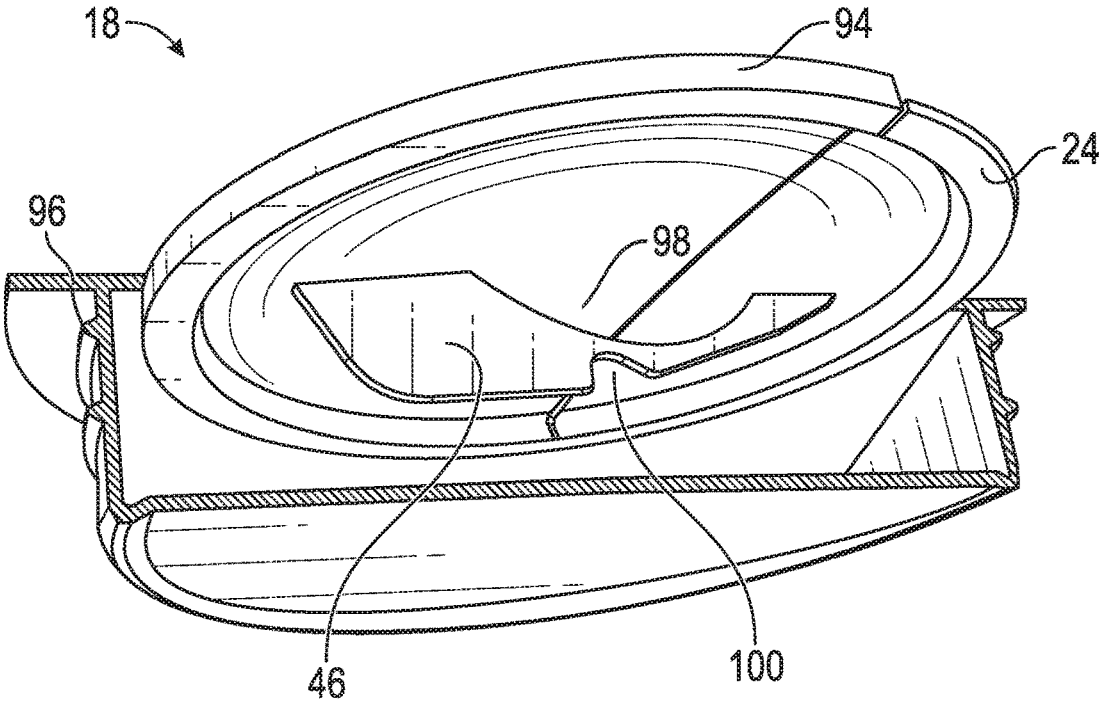
FIG. 14B is a partial, cross-sectional view of a container system with a removable cap in a collar in accordance with one embodiment of the present disclosure.
Figure 15A:
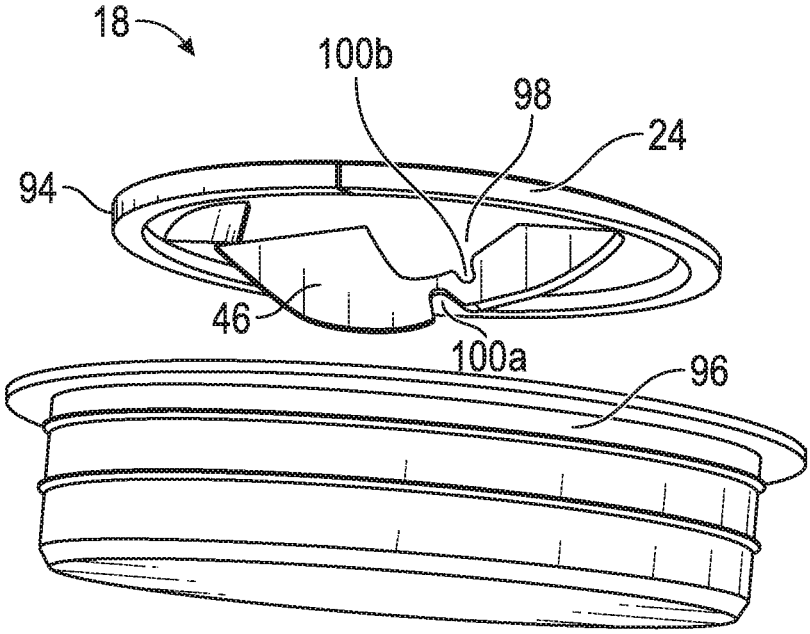
FIG. 15A is a side view of a container system with a removable cap out of a collar in accordance with one embodiment of the present disclosure.
Figure 15B:
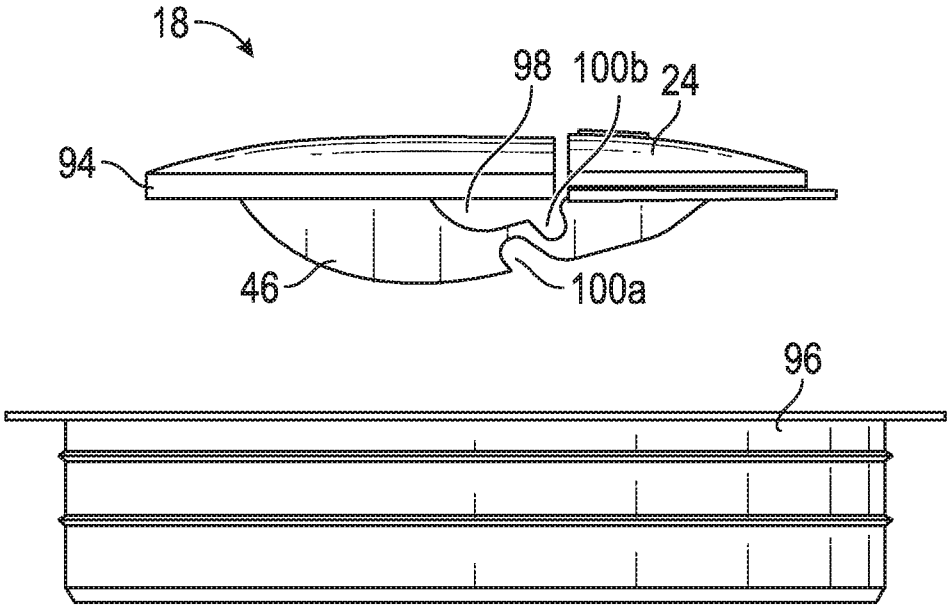
FIG. 15B is a side elevation view of the container system in FIG. 15A in accordance with one embodiment of the present disclosure.
Figure 15C:
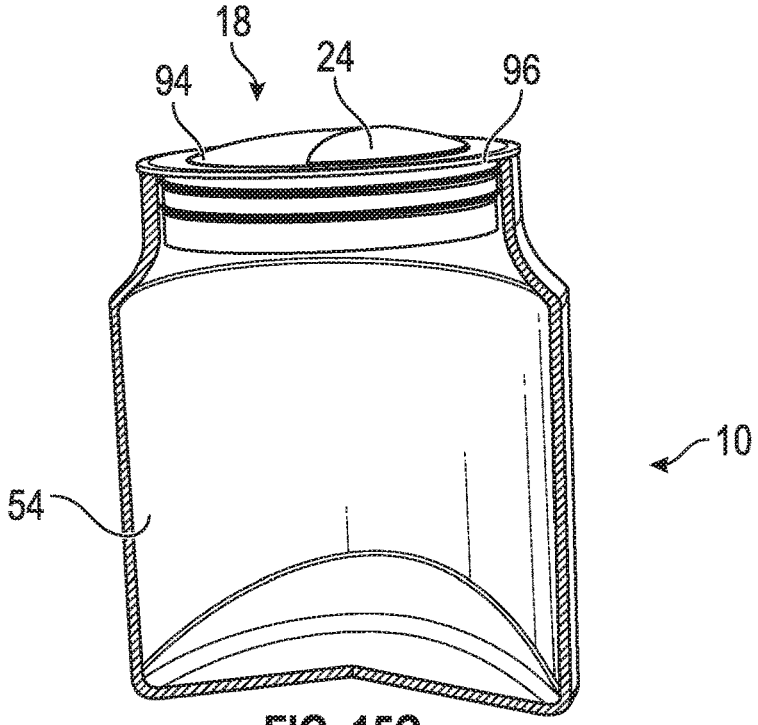
FIG. 15C is a cross-sectional side view of the container system in FIG. 15A with a removable cap in a collar of a container in accordance with one embodiment of the present disclosure.
Figure 15D:
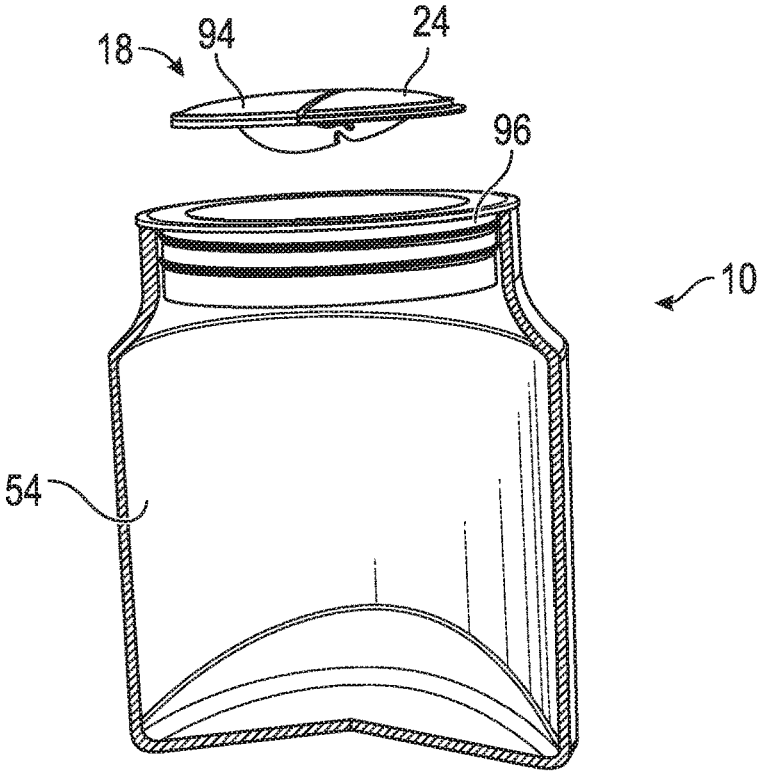
FIG. 15D is a cross-sectional side view of the container system in FIG. 15A with a removable cap out of a collar of a container in accordance with one embodiment of the present disclosure.

FIGS. 14A and 14B show perspective views of a container 10 where a disc 24 partially covers an upper area or surface of the cap 18. In this embodiment, a bias member 46 extends from a lower surface of the disc 24 to a lower surface of the body 94. A space 98 is provided between the bias member 46 and the body 94, and an inset 100 is positioned on an opposing side of the bias member 46 from the space 98. The space 98 and inset 100 define a portion of the bias member 46 with a reduced width. Thus, when a user presses the disc 24 downward relative to the body 94, the reduced width portion of the bias member 46 flexes and bends to allow the displacement of the disc 24. Like other embodiments, a user can then grasp an edge or surface to remove the cap 18 from, in this embodiment, a collar 96. The cap 18 and the body 94 collectively define an outer surface with a diameter configured rest within an inner diameter of the collar 96, either with an interference fit or other fit. When the user releases the disc 24, the resiliency of the bias member 46 presses the disc 24 back to its original position with a predetermined force.

FIGS. 15A-15D show a further embodiment of the cap 18 where the cap 18 comprises a body 94 and disc 24 that are positionable in a collar 96. In this embodiment, the bias member 46 has two insets 100*a*, 100*b*, one on each side of the bias member 46, to allow the displacement of the disc 24 in response to a predetermined force. Though the disc 24 is described as partially covering a surface of area of the cap 18, it will be appreciated that embodiments of the present disclosure include caps 18 where the disc 24 encompasses half or a majority or the entirety of the surface of area of a cap 18. The body 94 can complement the disc 24 if the body 94 is present in the embodiment of the cap 18.

Figure 16A:
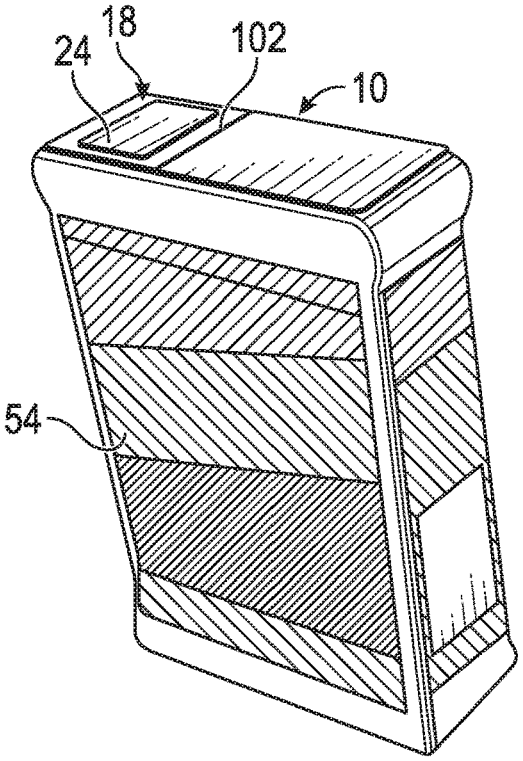
FIG. 16A is a perspective view of a container system with a removable cap in a first position in accordance with one embodiment of the present disclosure.
Figure 16B:
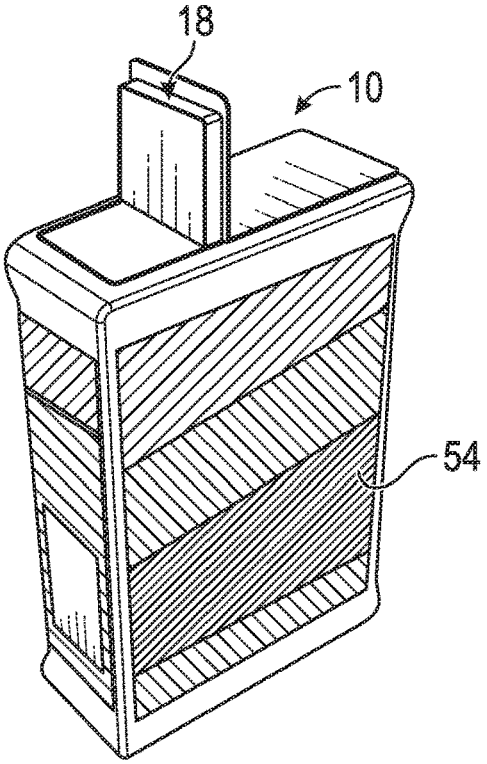
FIG. 16B is a perspective view of a container system with a removable cap in a second position in accordance with one embodiment of the present disclosure.

FIGS. 16A and 16B show an embodiment of the container with a cap 18 that is actuated about a hinge 102. Thus, when a user depresses a disc 24 and pulls an edge or surface, the cap 18 is not completely removed from the body of the container. Rather, the cap 18 is rotated about hinge 102.

The description of the container system has been presented for purposes of illustration and description, but is not intended to be exhaustive or limiting of the container system to the form disclosed. Many modifications and variations will be apparent to those of ordinary skill in the art. The embodiments described and shown in the figures were chosen and described in order to best explain the principles of the container system, the practical application, and to enable those of ordinary skill in the art to understand the container system.

While various embodiments have been described in detail, it is apparent that modifications and alterations of those embodiments will occur to those skilled in the art. Moreover, references made herein to "the container system" or aspects thereof should be understood to mean certain embodiments of the container system and should not necessarily be construed as limiting all embodiments to a particular description. It is to be expressly understood that such modifications and alterations are within the scope and spirit of the present disclosure, as set forth in the following claims.

What is claimed is:

1. A childproof container system, comprising:

a container having an inner surface that defines an interior volume, wherein the inner surface has an inwardly extending shoulder;

a cap positionable in the interior volume of the container such that a lower end of the cap contacts the shoulder, and an outer surface of the cap forms an interference fit with the inner surface of the container;

an inwardly extending lip at an upper end of the cap that defines an opening into the cap; and a disc positioned in the cap and biased against a bottom surface of the inwardly extending lip with a predetermined force, wherein the disc is configured to be pressed by a finger to overcome the predetermined force, and the inwardly extending lip is configured to receive a pulling force from a finger to overcome a friction force created by the interference fit and remove the cap from the container.

2. The childproof container system of claim 1, wherein the container comprises:

an outer tube extending from an upper end to a lower end; and an inner tube positioned within the outer tube, wherein an upper end of the inner tube is offset from the upper end of the outer tube by a predetermined distance to form the shoulder.

3. The childproof container system of claim 1, further comprising:

a bias member positioned in the cap to bias the disc against the bottom surface of the inwardly extending lip with the predetermined force, wherein the bias member is a foam material, and the predetermined force is at least 150 Newtons.

4. The childproof container system of claim 1, wherein the opening has a circular cross section with an inner diameter that is less than an outer diameter of a circular cross section of the disc.

5. The childproof container system of claim 1, further comprising:

a recessed film connected to the inner surface of the container and extending horizontally across the interior volume of the container to provide a seal within the container; and a tab on a top surface of the recessed film, wherein the tab is configured to be pulled with a predetermined force to break the connection between the recessed film and the inner surface of the container.

6. The childproof container system of claim 1, further comprising:

a film positioned on an upper surface of the container and extending across an upper opening of the container to provide a seal over the upper opening of the container; and a tab connected to the film, wherein the tab is configured to be pulled with a predetermined force to break the connection between the film and the upper surface of the container.

7. The childproof container system of claim 1, wherein the lower end of the cap contacts the shoulder via at least one intermediate layer, wherein the at least one intermediate layer is made from a wax material or a hot melt material.

8. The childproof container system of claim 1, wherein an outer diameter of the cap is at least 4 mils greater than an inner diameter of the container above the shoulder.

9. The childproof container system of claim 1, wherein a tape layer is at least partially wrapped around the outer surface of the cap.

10. A cap for a childproof container, comprising:

a body extending from an upper end to a lower end, wherein a flange defines an opening at the upper end of the body, and the opening provides access to an interior volume of the body;

a bias member positioned in the interior volume of the body; and an upper member positioned in the interior volume of the body between the bias member and the flange, wherein, in an initial state, the bias member biases the upper member against the flange with a predetermined force, and wherein, in an actuated state, an external force overcomes the predetermined force to press the upper member away from the flange to allow a finger to enter the interior volume and pull on the flange to remove the cap from a container.

11. The cap of claim 10, wherein the upper member is an upper surface of the bias member, and the upper member and the bias member are made of the same material, and a density of the upper member is greater than a density of the bias member.

12. The cap of claim 10, wherein the upper member has a central portion offset from an outwardly-extending flange in a longitudinal direction of the body, wherein the central portion is positionable in the opening, and the outwardly-extending flange is configured to contact the flange of the body, and wherein the upper member is configured to be pressed to compress the bias member and move the outwardly-extending flange from the flange in the activated state.

13. The cap of claim 10, wherein the bias member comprises a first helical member and a second helical member that intersect at least at one point, and the helical members compress to store mechanical energy.

14. The cap of claim 10, further comprising:

at least one fin extending from an outer surface of the body.

15. The cap of claim 14, wherein an upper surface of the at least one fin is smaller than a lower surface, and the surfaces are joined at an edge that is oriented toward the upper end of the body.

16. The cap of claim 10, further comprising:

a flange extending from an outer surface of the body proximate to the upper end of the body, wherein the flange is configured to contact an upper end of a container.

17. The cap of claim 10, further comprising:

a strip circumscribing at least a portion of an outer surface of the body, wherein the upper end of a container is configured to be positioned between the strip and the outer surface of the body, and wherein a tab is connected to the strip, and the tab is configured to be pulled to break the connection between the strip and the body.

18. A childproof container system, comprising:

a container having an inner surface that defines an interior volume, wherein the inner surface has an inwardly extending shoulder;

a cap positionable in the interior volume of the container such that a lower end of the cap contacts the shoulder, and an outer surface of the cap forms an interference fit with the inner surface of the container;

an inwardly extending lip at an upper end of the cap that defines an opening into the cap; and a disc and a bias member positioned in the cap, wherein the bias member is configured to bias the disc toward a bottom surface of the inwardly extending lip, wherein the disc is configured to be pressed by a finger to overcome a force produced by compressing the bias member, and the inwardly extending lip is configured to receive a pulling force from a finger to overcome a friction force created by the interference fit and remove the cap from the container.

19. The childproof container system of claim 18, wherein the bias member is a foam material, and the bias member biases the disc against the inwardly extending lip with a predetermined force.

20. The childproof container system of claim 18, wherein the cap has a retainer member, and a lower end of the bias member contacts the retainer member.

* * * * *